US006971247B2

(12) United States Patent
Yamazaki et al.

(10) Patent No.: US 6,971,247 B2
(45) Date of Patent: Dec. 6, 2005

(54) SHOWCASE

(75) Inventors: Shouichi Yamazaki, Maebashi (JP); Nobuo Kanbayashi, Kodama-gun (JP); Hayato Zushida, Kiryu (JP)

(73) Assignee: Sanden Corporation, Gunma (JP)

( * ) Notice: Subject to any disclaimer, the term of this patent is extended or adjusted under 35 U.S.C. 154(b) by 2 days.

(21) Appl. No.: 10/784,168

(22) Filed: Feb. 24, 2004

(65) Prior Publication Data

US 2004/0177635 A1 Sep. 16, 2004

(30) Foreign Application Priority Data

Mar. 11, 2003 (JP) ..... 2003-065046

(51) Int. Cl.[7] ..... A47F 3/04
(52) U.S. Cl. ..... 62/255; 454/193
(58) Field of Search ..... 62/255, 256; 454/193

(56) References Cited

U.S. PATENT DOCUMENTS 2,962,875 A * 12/1960 Barroero ..... 62/256
3,063,256 A * 11/1962 Gilbert ..... 62/256
3,168,818 A * 2/1965 Weber ..... 62/256
RE25,735 E * 3/1965 Lamb ..... 62/234
3,289,432 A * 12/1966 Brennan et al. ..... 62/256
3,324,676 A * 6/1967 Gerweck ..... 62/256
3,369,375 A * 2/1968 Gerweck et al. ..... 62/256
3,584,467 A * 6/1971 Barroero ..... 62/252
4,760,708 A * 8/1988 Karashima ..... 62/256
6,742,344 B2 * 6/2004 Vormedal ..... 62/89

FOREIGN PATENT DOCUMENTS

JP 2000-304425 11/2000

* cited by examiner

*Primary Examiner*—William E. Tapolcai
(74) *Attorney, Agent, or Firm*—Banner & Witcoff, Ltd.

(57) ABSTRACT

A showcase includes air outlets provided at an upper rear end of a goods-storing room, and shelf ducts individually provided at lower faces of goods shelves. Cold air discharged from the air outlets is caused to descend along a rear plate of the goods-storing room, and then flows through the shelf ducts from rear ends towards front ends of the goods shelves while being partly discharged downward, whereby the cold air can be discharged downward from the shelf ducts to lower goods shelves, making it possible to efficiently cool goods placed on the goods shelves, even if no air curtain is formed in front of a showcase body. Accordingly, the visibility of upper goods shelves can be improved by using an upper face of the showcase formed by a transparent top plate.

22 Claims, 5 Drawing Sheets

SHOWCASE

CROSS-REFERENCE TO THE RELATED ART

This application incorporates by reference the subject matter of Application No. 2003-065046, filed in Japan on Mar. 11, 2003, on which a priority claim is based under 35 U.S.C §119(a).

BACKGROUND OF THE INVENTION

1. Technical Field

The present invention relates to a showcase installed in a shop such as a convenience store for cooling and storing goods such as foods, beverages, and the like.

2. Related Art

A showcase is known which comprises a showcase body having a front opening, a goods-storing room formed in the showcase body, a plurality of goods shelves arranged in the goods-storing room so as to be vertically spaced from one another, a ventilation passage formed along bottom, rear and upper faces of the goods-storing room, and a cooler and a blower that are disposed in the ventilation passage, and in which air cooled by the cooler after being sucked via an air inlet provided at a lower front end of the goods-storing room into the ventilation passage is discharged from an air outlet provided at an upper front end of the goods-storing room, thereby forming an air curtain at the front opening of the showcase body to improve the cooling efficiency (see, JP-A-2000-304425, for instance).

However, the just-mentioned showcase has a low visibility of upper goods shelves, especially, of the uppermost one, since an upper face of the goods-storing room is covered by an upper wall of the showcase body, and accordingly the exhibition effect of goods is degraded. To improve the visibility, the upper face of the showcase body may be formed by a transparent top plate, however, such arrangement requires that the air outlet of the ventilation passage be formed at an upper rear end of the goods-storing room, resulting in a problem that downward flow of air discharged from the air outlet is prevented by the uppermost goods shelf, and hence no air curtain can be formed in front of the showcase body, making it impossible to efficiently cool the inside of the goods-storing room.

SUMMARY OF THE INVENTION

An object of the present invention is to provide a showcase capable of efficiently cooling the inside of a goods-storing room, even if no air curtain is formed in front of a showcase body.

According to the present invention, there is provided a showcase which comprises a showcase body having a front opening, a goods-storing room formed in the showcase body, a plurality of goods shelves arranged in the goods-storing room so as to be vertically spaced from one another, a ventilation passage formed along a rear face of the goods-storing room, and a cooler and a blower that are disposed in the ventilation passage. In this showcase, an air outlet for discharging air, cooled by the cooler after being sucked through an air inlet provided at a lower front end of the goods-storing room into the ventilation passage, to the goods-storing room is provided at an upper rear end of the goods-storing room, so as to cause at least part of air discharged therefrom to descend along the rear face of the goods-storing room between the rear face of the goods-storing room and rear ends of the goods shelves, and air passages are individually provided at lower faces of most of the goods shelves, so as to permit the air descending along the rear face of the goods-storing room to flow therethrough from the rear ends toward front ends of these goods shelves and permit part of the air flowing therethrough to be discharged downward.

With the showcase of this invention, at least part of the air cooled in the ventilation passage and then discharged therefrom to the goods-storing room through the air outlet is caused to flow through the air passage of each goods shelf, and part of the cold air flowing through the air passage is discharged therefrom toward the lower goods shelf. Thus, goods placed on the goods shelves can be efficiently cooled by the cold air discharged downward from the air passages, even if no air curtain is formed in front of the showcase body. Since the efficient cooling can be achieved even in a case where the air outlet is provided at the upper rear end of the goods-storing room, the upper face of the showcase body can be made transparent, whereby the visibility of upper goods shelves, especially, of the uppermost one, can be improved and hence the exhibition effect of goods can be advantageously enhanced. Another advantage is an increased freedom in designing the showcase body since, unlike the prior art, there is no structural limitation that the ventilation passage be formed up to the upper front end of the showcase body in order to form an air curtain in front of the showcase body.

In this invention, the air passages may be formed so as to discharge the air not only downward but also forward. In this case, the air in the air passages are discharged also from the fronts of the air passages, and hence dew condensation at the front ends of the goods shelves is prevented by the forwardly discharged air, making it possible to positively prevent adherence of dew condensation water.

Each of the goods shelves may be comprised of upper and lower shelf plates spaced at a distance from each other and defining the air passage therebetween, with the lower shelf plate formed with a plurality of ventilation holes through which the air in the air passage is discharged. In this case, the air passage formed between the upper and lower shelf plates of the goods shelf is simple in construction, and is hence advantageous in fabrication cost. The air in the air passage discharged downward from the ventilation holes can evenly cool goods that are placed on the lower goods shelf.

Each of the goods shelves may be provided at its rear end with an air guide member for causing the air descending along the rear face of the goods-storing room to flow into the air passage of the good shelf. In this case, the air descending along the rear face of the goods-storing room positively enters the air passages while being guided by the air guide members provided at the rear ends of the good shelves, making it possible to discharge an adequate amount of air from the air passages.

Each goods shelf may be provided with a plurality of air guide members spaced from one another in a width direction of the goods shelf, with the air guide members for an upper one of the goods shelves being smaller in number than those for a lower one of the goods shelves. In this case, a smaller number of the air guide members are provided for introduction of air into upper goods shelves, whereas a larger number of the air guide members are provided for lower goods shelves, and hence amounts of air flowing into the air passages of the respective goods shelves are made substantially uniform, whereby goods placed on the goods shelves can be cooled evenly.

Each of the goods shelves may be provided at its rear end with an air guide member for guiding the air descending along the rear face of the goods-storing room into between the rear end of the goods shelf and the rear face of the goods-storing room. In this case, the air descending along the rear face of the goods-storing room is guided into between the goods shelves and the rear face of the goods-storing room by means of the air guide members provided at the rear ends of the goods shelves, without flowing out toward the upper faces of the goods shelves, thus making it possible to positively establish, on the rear side of the goods shelves, the f low of air flowing into the air passages.

Each of the goods shelves is provided at its rear side with air guide plates that cover a gap between the rear end of the goods shelf and the rear face of the goods-storing room from both widthwise sides of the goods shelf. In this case, gaps between the goods shelves and the rear face of the goods-storing room are covered from both widthwise sides of the goods shelves by the air guide plates provided on the rear side of the goods shelves, and hence the air descending along the rear face of the goods-storing room is prevented from flowing out laterally of the goods shelves, making it possible to positively establish, on the rear side of the goods shelves, the flow of air flowing into the air passages.

Upper one or ones of the goods shelves may be provided at its and/or their front ends with a discharge restriction member of a predetermined height capable of restricting air on the goods shelf or shelves from being discharged forwardly. In this case, the air on the upper shelf or shelves is prevented from being discharged forward, and hence the air easily accumulates on the upper face or faces of the upper goods shelf or shelves. As a result, the air discharged from the air passage or passages is prevented from being excessively discharged from front or fronts of the upper goods shelf or shelves, making it possible to flow a correspondingly larger amount of air to lower goods shelves along the rear face of the goods-storing room.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION

Figure 1:
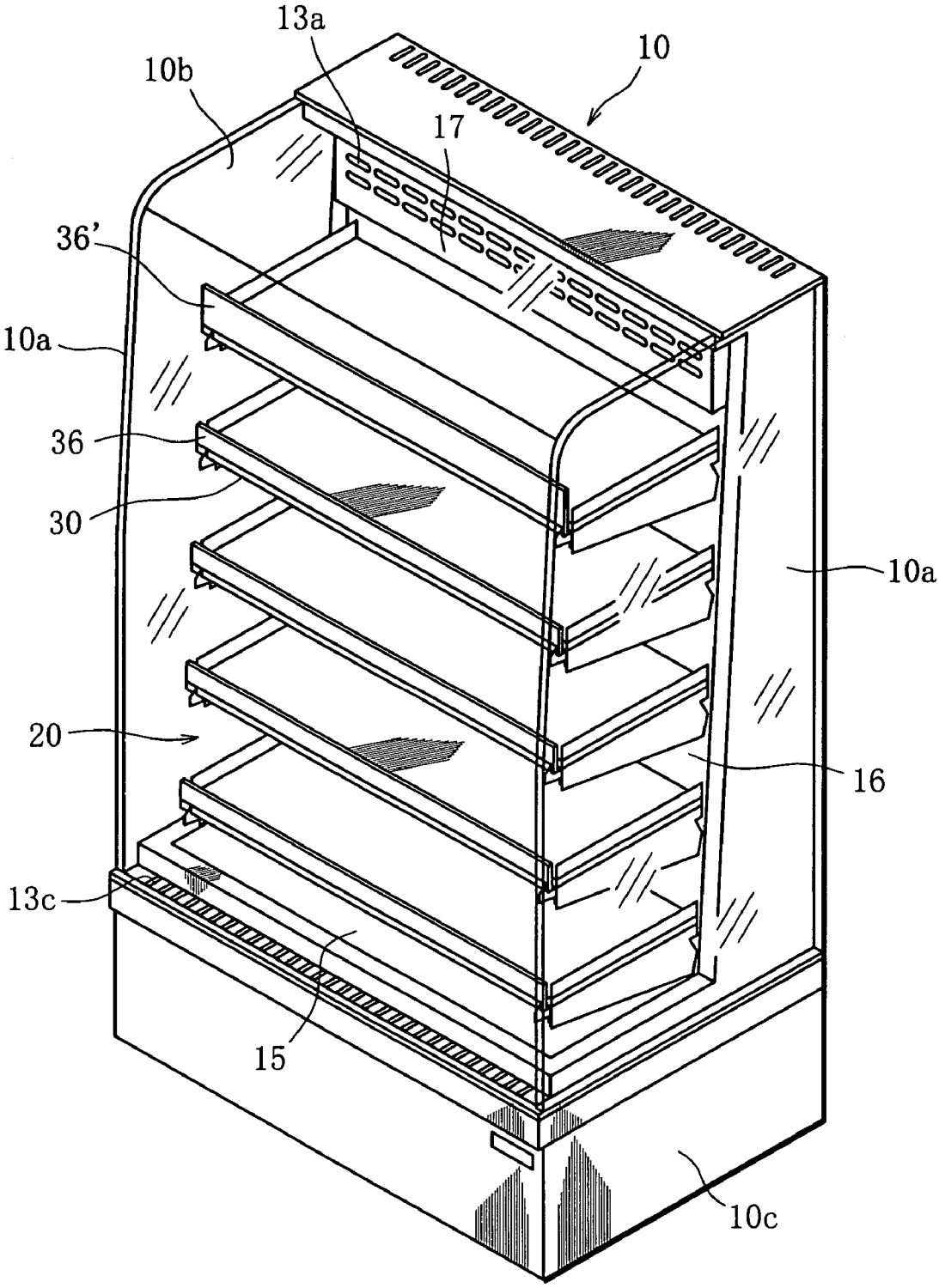
FIG. 1 is an overall perspective view of a showcase according to an embodiment of this invention.
Figure 2:
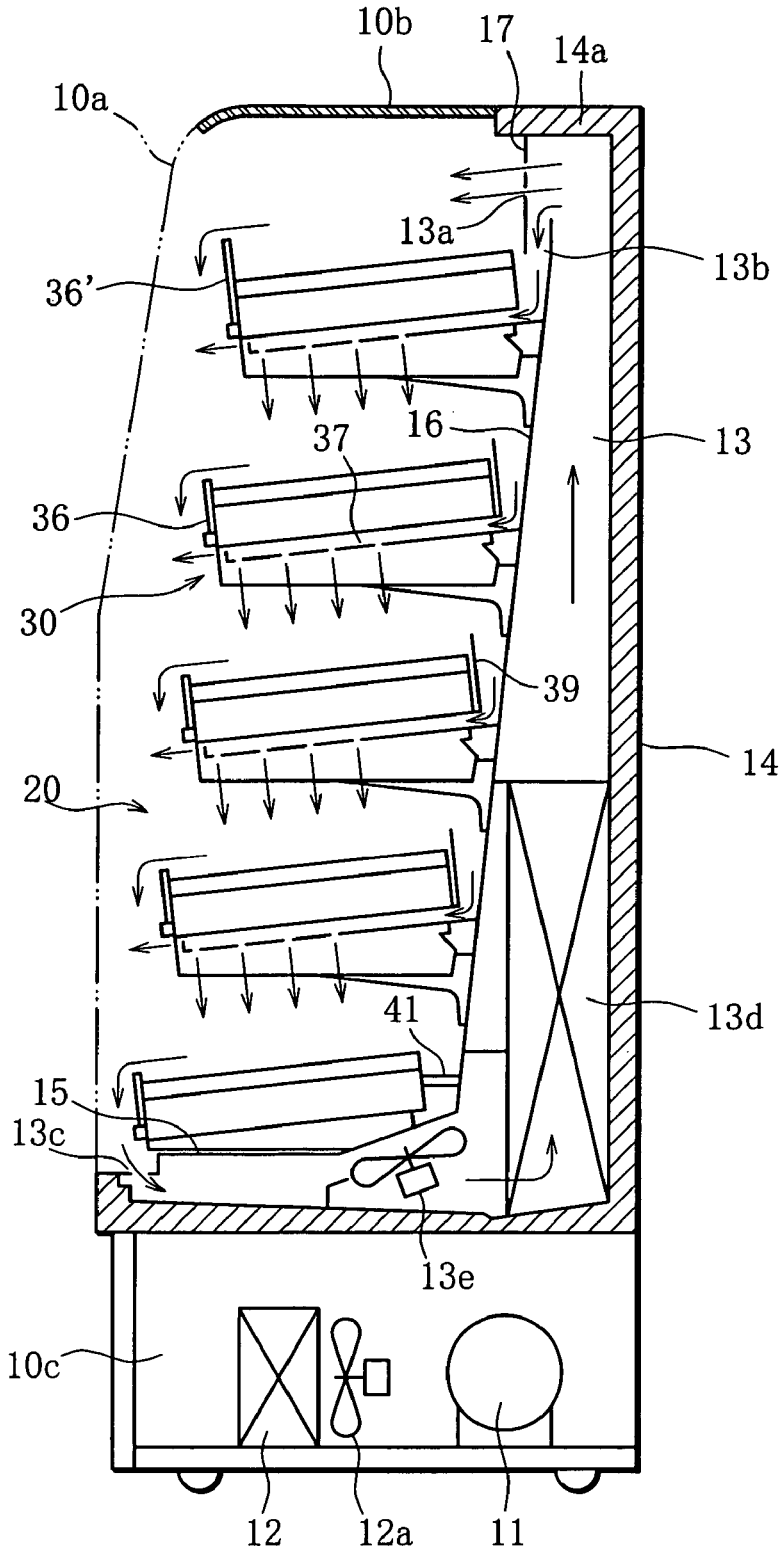
FIG. 2 is a sectional side view of the showcase.
Figure 3:
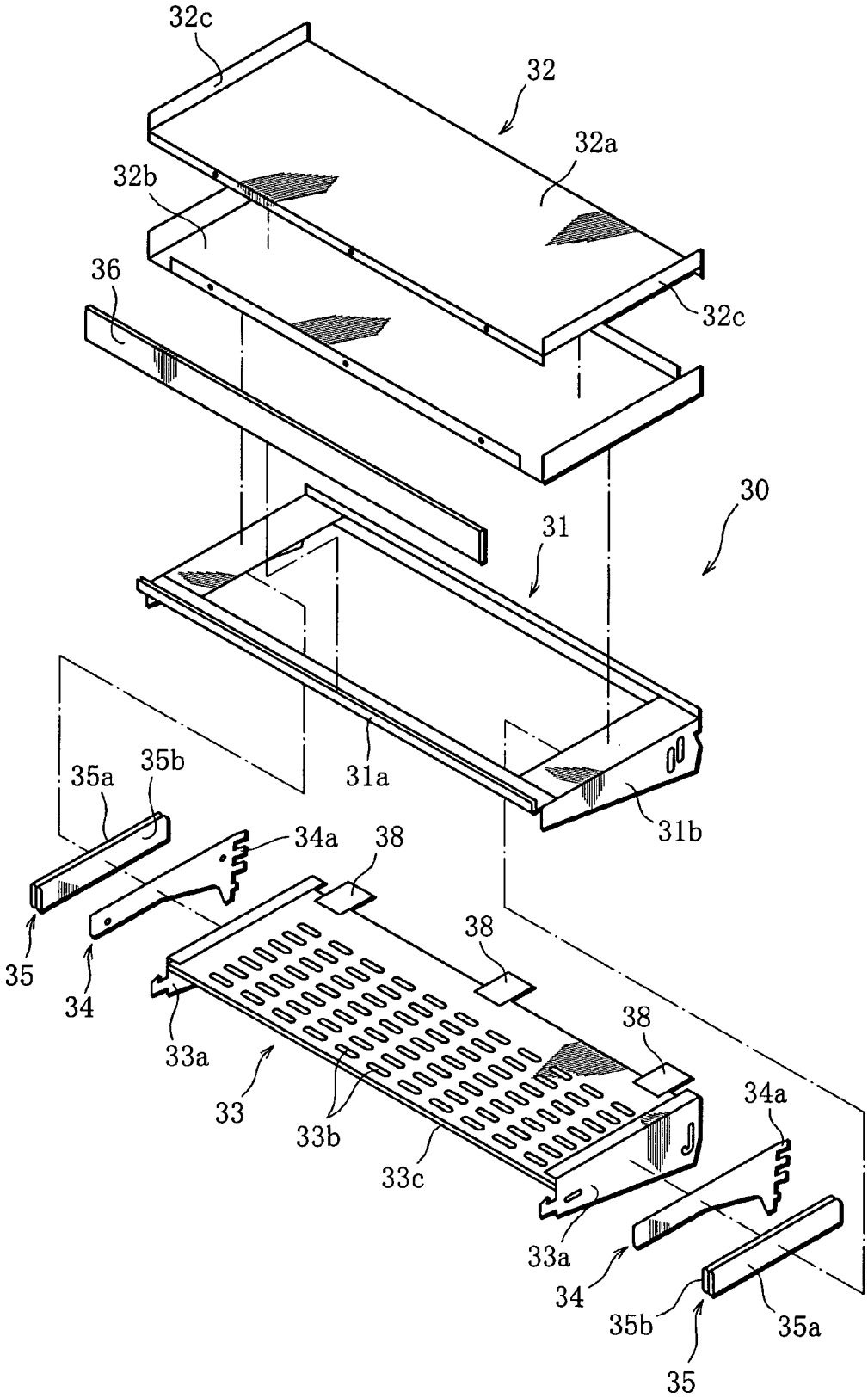
FIG. 3 is an exploded perspective view of a goods shelf.
Figure 4:
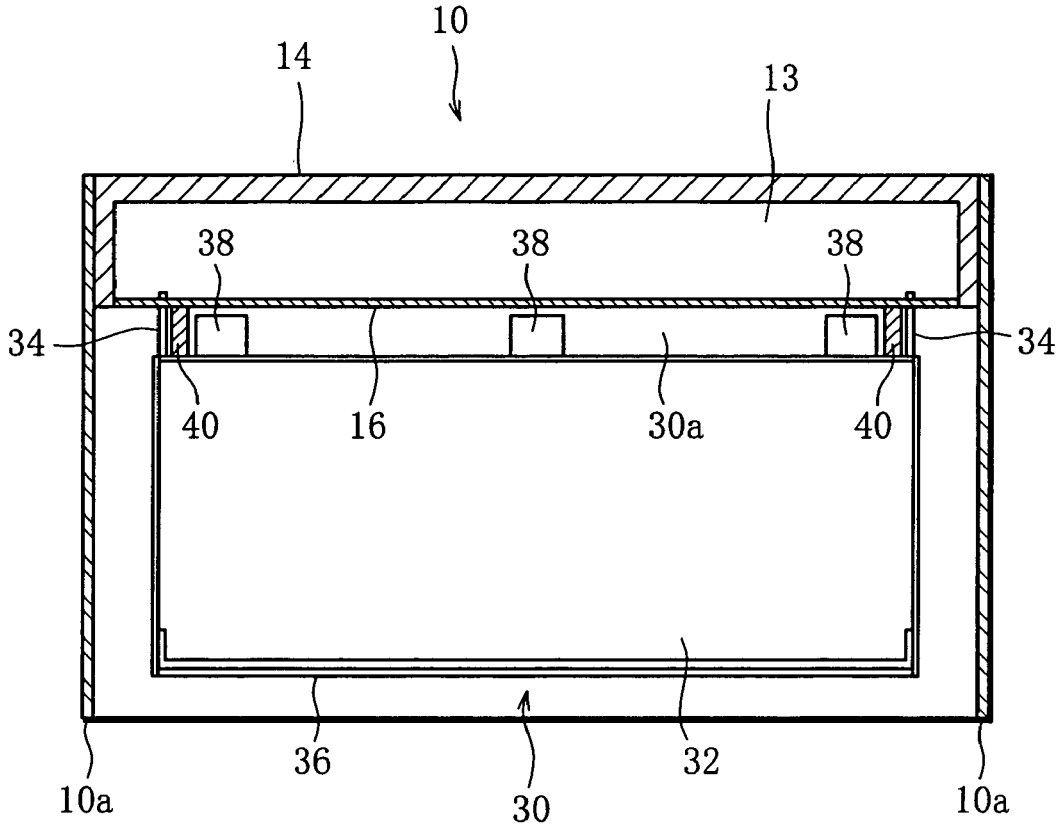
FIG. 4 is a sectional plan view of the showcase.
Figure 5:
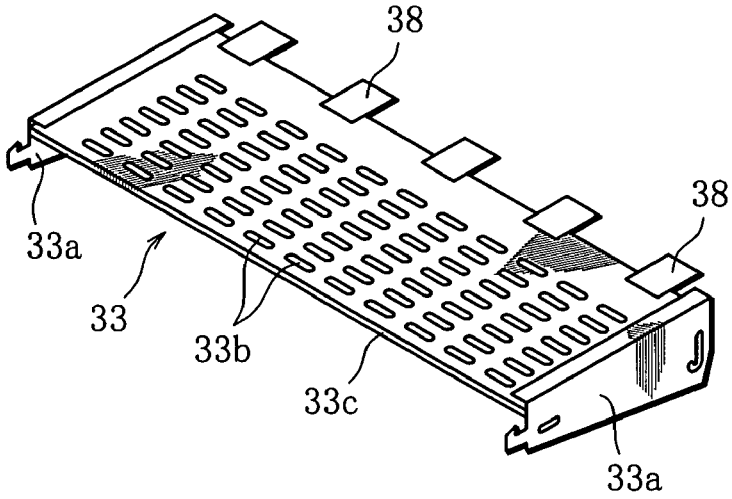
FIG. 5 is a perspective view of a fourth-stage lower shelf board.
Figure 6:
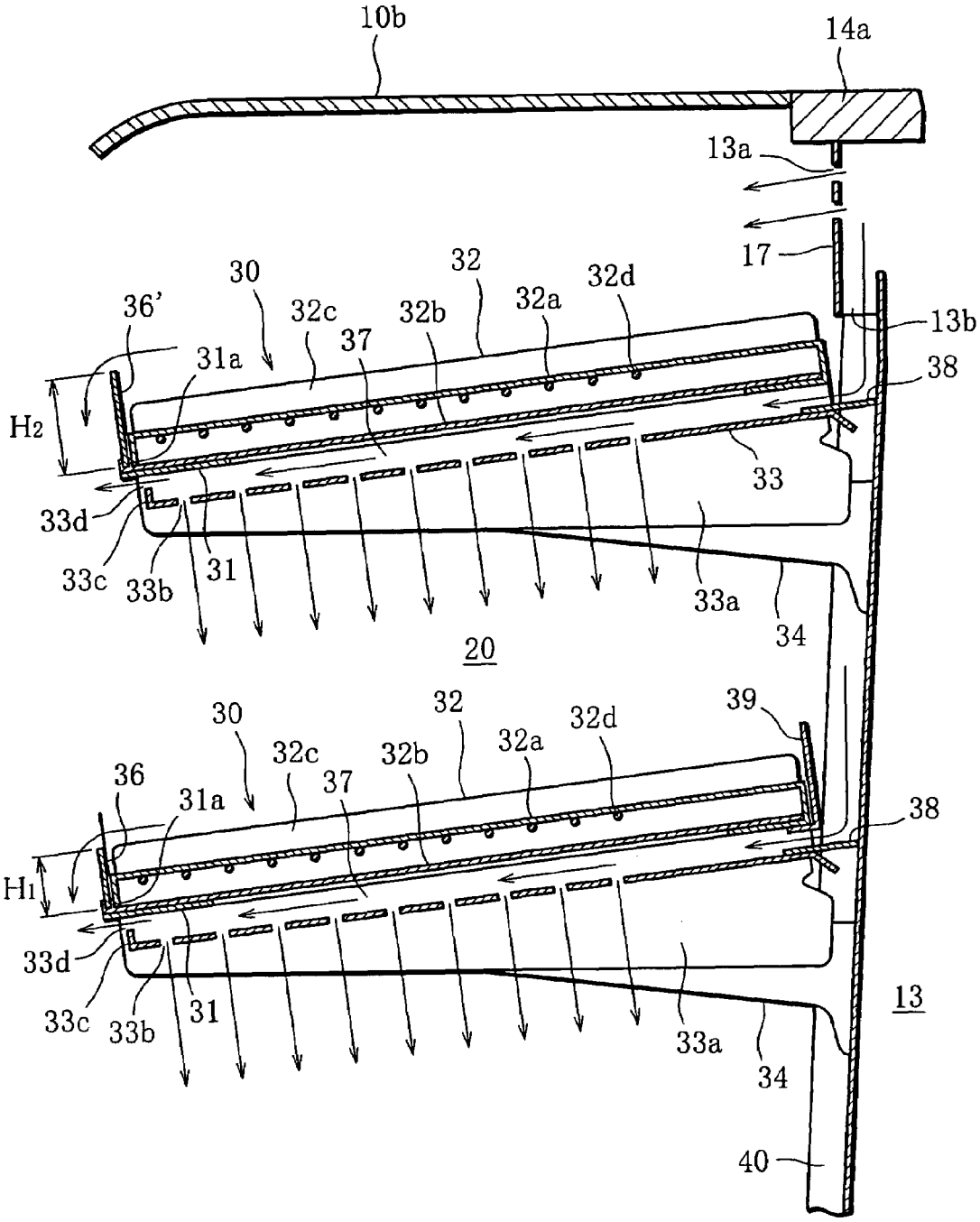
FIG. 6 is a sectional side view showing an essential part of the showcase.

Referring to FIGS. 1–6, a showcase according to an embodiment of this invention is shown, which comprises a showcase body 10 having a front opening, a goods-storing room 20 provided in the showcase body 10, and a plurality of goods shelves 30 that are arranged in five stages in the goods-storing room 20 so as to be vertically spaced from one another.

The showcase body 10 includes a pair of side plates 10*a* and a top plate 10*b* by which side faces and top face of the showcase body are covered respectively. The side plates 10*a* and top plate 10*b* are each constituted by a transparent member such as a glass plate, acrylic plate, or the like, so that the interior of the showcase body 10 can be seen from outward. A machinery room 10*c* is provided beneath the showcase body 10. Pieces of refrigeration equipment such as a compressor 11, condenser 12, condenser fan 12*a*, etc., are accommodated in the machinery room 10*c*.

In the showcase body 10, a ventilation passage 13 is provided, which extends along bottom and rear faces of the goods-storing room 20. The ventilation passage 13 is surrounded by a thermally insulating wall 14 and partitioned from the goods-storing room 20 by means of bottom and rear plates 15, 16 interposed therebetween. An upper end of the ventilation passage 13 is covered by an upper face portion 14*a* of the thermally insulating wall 14. An air guide plate 17 provided at a lower face of the upper face portion 14*a* is formed with a large number of ventilation holes serving as first air outlets 13*a*. The air guide plate 17 extends vertically downward from the upper face portion 14*a* of the thermally insulating wall 14. A lower end side of the air guide plate faces an upper end side of the rear plate 16, so that they overlap each other with a spacing therebetween. Thus, a second air outlet 13*b* is defined between the air guide plate 17 and the rear plate 16. Specifically, part of air in the ventilation passage 13 is discharged forward from the first air outlets 13*a*, and the remaining air is discharged downward from the second air outlet 13*b* to flow downward along the rear plate 16. An air inlet 13*c* for the ventilation passage 13 is provided at a lower end of the front opening of the showcase body 10, so that air in the goods-storing room 20 is sucked into the ventilation passage 13 via the air inlet 13*c*. In the ventilation passage 13, a cooler 13*d* and a blower 13*e* are provided. The cooler 13*d* is disposed on the rear face side of the ventilation passage 13, whereas the blower 13*e* is disposed on the bottom face side thereof.

The goods-storing room 20 is surrounded by the side plates 10*a*, top plate 10*b*, bottom plate 15 and rear plate 16, and is arranged that goods are loaded onto and unloaded from goods shelves 30 from the front side of the goods-storing room.

Each of the goods shelves 30 is constituted by a shelf body 31 formed into a frame shape, an upper shelf plate 32 disposed on the shelf body 31, a lower shelf plate 33 disposed below the shelf body 31, a pair of left and right brackets 34 supporting the shelf body 31, a pair of left and right slide rails 35 for a depthwise slide motion of the shelf body 31, and a goods guard 36 disposed at a front end of the shelf body 31. A gap 30*a* for air flow is defined between a rear end of the goods shelf and the rear plate 16 of the showcase body 10.

The shelf body 31 has its front end provided with a grooved retainer 31*a* for detachably holding the goods guard 36, and widthwise ends thereof provided with side portions 31*b* extending downward.

The upper shelf plate 32 is constituted by upper and lower members 32*a*, 32*b* each of which is formed into a flat plate. The upper member 32*a* has its widthwise ends provided with side wall portions 32 extending upward. The upper shelf plate 32 is formed into a box by assembling the upper and lower members 32*a*, 32*b* with a spacing therebetween, and fixed to the upper face of the shelf body 31. Further, the upper shelf plate 32 is mounted at its bottom face with a heater 32*d* that is used to heat goods placed on the goods shelf 30.

The lower shelf plate 33 is formed into a flat plate and disposed below the shelf body 31 with a spacing from the bottom face of the upper shelf plate 32. A shelf duct 37 is formed between the upper and lower shelf plates 32 and 33, and has an open rear end for air intake. Widthwise side faces of the shelf duct 37 are covered respectively by a pair of side plates 33*a* attached to the lower shelf plate 33. Air in the shelf duct 37 is discharged downward through a number of air outlets 33*b* formed in the lower shelf plate 33, and also discharged forward from the front end side of the lower shelf plate 33. At the front end of the lower shelf plate 33 is provided a front wall 33*c* having a height smaller than the spacing between the shelf plates 32, 33, so that air can be discharged from an opening 33*d* between the upper end of the front wall 33*c* and the shelf body 31.

The brackets 34 are formed to extend the depthwise direction, and coupled to the side plates 33*a* of the lower shelf plate 33. Each bracket 34 has its rear end formed with an engagement piece 34*a* that is adapted to be engaged with the rear plate 16 of the showcase body 10. Specifically, the engagement piece 34*a* is engageable with an arbitrary one of a number of holes (not shown) provided in the rear plate 16 to be vertically spaced from one another.

Each of the slide rails 35 is a conventional one which is constituted by a pair of slide members 35*a*, 35*b* assembled to be slidable to each other, and interposed between the inner side of the side portion 31*b* of the shelf body 31 and the bracket 34, thus coupling the shelf body 31 to the bracket 34 for movement in the depthwise direction.

Each goods guard 36 is constituted by a plate member such as an acrylic plate, and detachably mounted to the retainer 31*a* of the shelf body 31. As compared to a height dimension H1 of goods guards 36 mounted to goods shelves 30 disposed at the second to fifth stages counted from top, a height dimension H2 of the goods guard 36' mounted to the goods shelf 30 disposed at the uppermost stage is larger by a predetermined height. Thus, the goods guard 36' for the uppermost stage serves as a discharge restriction member that makes it possible to suppress air on the uppermost stage goods shelf 30 from being discharged forwardly.

At the rear end of the lower shelf plate 33, a plurality of first air guide plates 38 for introducing air into the shelf duct 37 are mounted so as to be spaced from one another in the width direction. The first air guide plates 38 are attached so as to project into a gap 30*a* between the lower shelf plate 33 and the rear plate 16, so that part of air that descends along the rear plate 16 is guided by each of the first air guide plates 38 toward the corresponding shelf duct 37. For each of the first to third stage goods shelves 30, three first air guide plates 38 are mounted (see FIG. 3), whereas five first air guide plates 38 are mounted to the fourth stage goods shelf 40 (see FIG. 5).

Furthermore, the second to fourth stage goods shelves 30 are provided with second air guide plates 39 for guiding air that descends along the rear plate 16 toward the gaps 30*a* between the shelves 30 and the rear plate 16. Each of the second air guide plates 39 is mounted to the rear end side of the shelf body 31 concerned so as to extend upward, and is slightly inclined forward so as to easily guide the descending air.

On the backward of each goods shelf 30, a pair of third air guide plates 40 are provided that cover the gap 30*a* between the goods shelf 30 and the rear plate 16 from both widthwise sides. The third air guide plate 40 are each constituted by a soft member such as rubber that is expandable in the vertical direction, and mounted to the rear plate 16 of the showcase body 10.

The lowermost stage goods shelf 30 is provided with no shelf duct 37, and the gap 30*a* between its rear end and the rear plate 16 is closed by an air flow restriction plate 41.

In the showcase constructed as explained above, air sucked from the air inlet 13*c* into the ventilation passage 13 is cooled by means of the cooler 13*d*, and the cooled air is discharged from the first and second air outlets 13*a*, 13*b* of the ventilation passage 13, whereby the inside of the goods-storing room 20 is cooled. The air discharged from the first air outlet 13*a* flows forward along the upper face of the uppermost stage goods shelf 30, whereas the air discharged from the second air outlet 13*b* passes through the gap 30*a* between the goods shelves 30 and the rear plate 16, and descends along the rear plate 16 of the showcase body 10. As for the air descending along the rear plate 16, the second air guide plates 39 restrict the air from flowing toward the upper faces of the second to fourth stage goods shelves 30, and the third air guide plates 40 restrict the air from flowing toward the sides of the goods shelves 30.

The air descending along the rear plate 16 flows into the rear end side of the shelf ducts 37 with the aid of the first guide plates 38 of the first to fourth stage goods shelves 30. At this time, the air descending along the rear plate 16 enters into the shelf ducts 37 of the goods shelves 30 in sequence from upper one to lower one. Since the first air guide plates 38 for upper goods shelves 30 (the first to third stage goods shelves) are smaller in number as compared to those of a lower goods shelf 30 (the fourth stage goods shelf), amounts of air flowing into the shelf ducts 37 of the goods shelves 30 are substantially made even for these upper and lower ducts.

Then, the air flowing into each of the shelf ducts 37 flows therethrough toward the front end of the goods shelf 30, while being discharged to the upper face of the next lower goods shelf 30 through the air outlets 33*b* of the lower shelf plate 33. As a result, goods placed on the goods shelf 30 are cooled by the air discharged from the shelf duct 37 of the upper goods shelf 30. The goods guard 36' mounted to the uppermost stage goods shelf 30 has a height dimension that is larger than that of the goods guards 36 for the other goods shelves 30, so that air may easily accumulate on the upper face of the uppermost stage goods shelf 30 as compared to the other goods shelves 30. Thus, the air discharged from the first air outlets 13*a* is prevented from being excessively discharged from front of the uppermost stage goods shelf 30. Meanwhile, air in the shelf duct 37 is also discharged from the opening 33*d* at the front end side of the shelf duct 37, and the discharged air serves to prevent drew condensation on the front end side of the goods shelf 30.

As described above, according to the showcase of this embodiment, the first and second air outlets 13*a*, 13*b* of the ventilation passage 13 are formed at the upper rear end of the goods-storing room 20 so as to cause air discharged from the second air outlet 13*b* to descend along the rear plate 16 of the goods-storing room 20, and the shelf ducts 37 are individually provided at the lower faces of the goods shelves 30 except for the lowermost goods shelf, so that the air descending along the rear plate 16 flows from the rear end toward the front end of each goods shelf 30 while being partly discharged toward below the goods shelf 30. Thus, it is possible to discharge cold air from each shelf duct 70 toward the lower goods shelf 30, and hence goods placed on the goods shelves 30 can be efficiently cooled, even if no air curtain is formed in front of the showcase body 10. This is advantageous in that the visibility of upper goods shelves 30, especially, of the uppermost one, can be improved to enhance the exhibition effect of goods by providing the air outlets 13*a*, 13*b* at the upper rear end of the goods-storing room and by making the upper face of the showcase body 10 transparent.

Another advantage can be achieved that the freedom in designing the showcase body 10 is enhanced, since the provision of an air curtain in front of the showcase body 10 is unnecessary and hence the showcase body 10 is free from such a structural limitation in the prior art that the ventilation passage be formed up to the upper front end of the showcase body.

The shelf ducts 37 are formed at their front ends with openings 33*d* from which the air in the shelf ducts 37 is discharged forwardly, and hence dew condensation at the front ends of the goods shelves 30 is prevented, making it possible to positively prevent adherence of dew condensation water.

Each of the shelf ducts 37 is formed between the upper and lower shelf plates 32, 33, and the lower shelf plate 33 is formed with a number of ventilation holes 33*b* through which the air in the shelf duct 37 is discharged. Thus, the shelf ducts 37 are simple in construction and advantageous in fabrication cost. In this case, the air in the shelf ducts 37 is discharged downward from a number of ventilation holes 33*b*, thus making it possible to evenly cool goods placed on the lower goods shelf 30.

It is also possible to cause the air descending along the rear plate 16 to positively flow into the shelf ducts 37 by guiding the air by the first air guide plates 38 provided at the rear ends of the good shelves 30, making it possible to ensure that the air flows into the shelf ducts 37, thus obtaining an adequate amount of air to be discharged from the shelf ducts 37.

In this case, the first air guide plates 38 for an upper goods shelf 30 are smaller in number than those for a lower goods shelf 30, and hence amounts of air flowing into the shelf ducts 37 of the goods shelves 30 are substantially made even throughout from the uppermost shelf to the lowermost shelf, whereby goods placed on the goods shelves 30 can be cooled evenly.

The air descending along the rear plate 16 is guided into gaps 30*a* between the goods shelves 30 and the rear plate 16 by the second air guide members 39 provided at the rear ends of the goods shelves 30, the air descending between the goods shelves 30 is prevented from flowing out toward the upper faces of the goods shelves 30, making it possible to positively establish, on the rear side of the goods shelves 30, the flow of air flowing into the shelf ducts 37.

The gaps 30*a* between the goods shelves 30 and the rear plate 16 are covered from both widthwise sides of the goods shelves 30 by pairs of the third air guide plates 40 provided on the rear side of the goods shelves 30, and hence the air descending along the rear plate 16 is prevented from flowing out laterally of the goods shelves 30, making it possible to positively establish, on the rear side of the goods shelves 30, the flow of air flowing into the shelf ducts 37.

The goods guard 36' attached to the uppermost goods shelf 30 is formed to have a height larger than that of the goods guards 36 of the other goods shelves 30, and hence the air more easily accumulates on the upper face of the uppermost goods shelf 30 than on the upper faces of the other goods shelves 30. As a result, the air discharged from the first air outlet 13*a* is prevented from being excessively discharged from front of the uppermost goods shelf 30, making it possible to flow a correspondingly larger amount of air to the lower goods shelves along the rear plate 16.

Although the goods guard 36' which is large in height is attached only to the uppermost goods shelf 30 in the embodiment, such goods guards 36' may be attached to one or more other upper goods shelves 30.

What is claimed is:

1. A showcase comprising:

a showcase body having a limit opening;

a goods-storing room formed in said showcase body;

a plurality of goods shelves arranged in said goods-storing room so as to be vertically spaced from one another;

a ventilation passage formed along a rear face of said goods-storing room; and a cooler and a blower that are disposed in said ventilation passage, wherein an air outlet for discharging air, cooled by said cooler after being sucked through an air inlet provided at a lower front end of said goods-storing room into said ventilation passage, to said goods-storing room is provided at an upper rear end of said goods-storing room, so as to cause at least part of air discharged therefrom to descend along the rear face of said goods-storing room between the rear face of said goods-storing room and rear ends of said goods shelves, and air passages are individually provided at lower faces of most of said goods shelves, so as to permit the air descending along the rear face of said goods-storing room to flow therethrough from the rear ends towards front ends of these goods shelves and permit part of the air flowing therethrough to be discharged downward.

2. The showcase according to claim 1, wherein said air passages are formed so as to discharge the air not only downward but also forward.

3. The showcase according to claim 1, wherein each of said goods shelves is comprised of upper and lower shelf plates spaced at a distance from each other and defining the air passage therebetween, with to lower shelf plate formed with a plurality of ventilation holes trough which the air in the air passage is discharged.

4. The showcase according to claim 2, wherein each of the goods shelves is comprised of upper and lower shelf plates spaced at a distance from each other and defining the air passage therebetween, with the lower shelf plate formed with a plurality of ventilation holes through which the air in the air passage is discharged.

5. The showcase according to claim 2, wherein each of said goods shelves is provided at its rear end with an air guide member for causing the air descending along the rear face of said goods-storing room to flow into the air passage of the good shelf.

6. The showcase according to claim 5, wherein each of said goods shelves is provided with a plurality of air guide members spaced from one another in a width direction of the goods shelf, with the air guide members for an upper one of said goods shelves being smaller in number than those for a lower one of said goods shelves.

7. The showcase according to claim 3, wherein each of said goods shelves is provided at its rear end with an air guide member for causing the air descending along the rear face of said goods-storing room to flow into the air passage of the good shelf.

8. The showcase according to claim 7, wherein each of said goods shelves is provided with a plurality of air guide members spaced from one another in a width direction of the goods shelf, with the air guide members for a upper one of said goods shelves being smaller in number than those for a lower one of said goods shelves.

9. The showcase according to claim 2, wherein each of said goods shelves is provided at its rear end with an air guide member for guiding the air descending along the rear face of said goods-storing room into between the rear end of the goods shelf and the rear face of said goods-storing room.

10. The showcase according to claims 3, wherein each of said goods shelves is provided at its rear end with an air guide member for guiding the air descending along the rear face of said goods-storing room into between the rear end of the goods shelf and the rear face of said goods-storing room.

11. The showcase according to claims 4, wherein each of said goods shelves is provided at its rear end with an air guide member for guiding the air descending along the rear face of said goods-storing room into between the rear end of the goods shelf and the rear face of said goods-storing room.

12. The showcase according to claim 1, wherein each of said goods shelves is provided at its rear side with air guide plates that cover a gap between the rear end of the goods shelf and the rear face of said goods-storing room from both widthwise sides of the goods shelf.

13. The showcase according to claim 2, wherein each of said goods shelves is provided at its rear side with air guide plates that cover a gap between the rear end of the goods shelf and the rear face of said goods-storing room from both widthwise sides of the goods shelf.

14. The showcase according to claim 3, wherein each of said goods shelves is provided at its rear side with air guide plates that cover a gap between the rear end of the goods shelf and the rear face of said goods-storing room from both widthwise sides of the goods shelf.

15. The showcase according to claim 4, wherein each of said goods shelves is provided a its rear side with air guide plates that cover a gap between the rear end of the goods shelf and the rear face of said goods-storing room from both widthwise sides of the goods shelf.

16. The showcase according to claim 1, wherein upper one or ones of said goods shelves are provided at its and/or their front ends with a discharge restriction member of a predetermined height capable of restricting air on the goods shelf or shelves from being discharged forwardly.

17. The showcase according to claim 2, wherein upper one or ones of said goods shelves are provided at its and/or their front ends with a discharge restriction member of a predetermined height capable of restricting air on the goods shelf or shelves from being discharged forwardly.

18. The showcase according to claim 3, wherein upper one or ones of said goods shelves are provided at its and/or their front ends with a discharge restriction member of a predetermined height capable of restricting air on the goods shelf or shelves from being discharged forwardly.

19. The showcase according to claim 4, wherein upper one or ones of said goods shelves are provided at its and/or their front ends with a discharge restriction member of a predetermined height capable of restricting air on the goods shelf or shelves from being discharged forwardly.

20. A showcase comprising:

a showcase body having a front opening;

a goods-storing room formed in said showcase body;

a plurality of goods shelves arranged in said goods-storing room so as to be vertically spaced from one another;

a ventilation passage formed along a rear face of said goods-storing room; and a cooler and a blower tat are disposed in said ventilation passage, wherein an air outlet for discharging air, cooled by said cooler after being sucked through an air inlet provided at a lower front end of said goods-storing room into said ventilation passage, to said goods-storing room is provided at an upper rear end of said goods-storing room, so as to cause at least part of air discharged therefrom to descend along the rear face of said goods-storing room between the rear face of said goods-storing room and rear ends of said goods shelves, and air passages are individually provided at lower faces of most of said goods shelves, so as to permit the air descending along the rear face of said goods-storing room to flow therethrough from the rear ends towards front ends of these goods shelves and permit part of the air flowing therethrough to be discharged downward, wherein each of said goods shelves is provided at its rear end with an air guide member for causing the air descending along the rear face of said goods-storing room to flow into the air passage of the good shelf, and each of said goods shelves is provided with a plurality of air guide members spaced from one another in a width direction of the goods shelf, with the air guide members for an upper one of said goods shelves being smaller in number than those for a lower one of said goods shelves.

21. A showcase comprising:

a showcase body having a front opening;

a goods-storing room formed in said showcase body;

a plurality of goods shelves arranged in said goods-storing room so as to be vertically spaced from one another;

a ventilation passage formed along a rear face of said goods-storing room; and a cooler and a blower that are disposed in said ventilation passage, wherein an air outlet for discharging air, cooled by said cooler after being sucked through an air inlet provided at a lower front end of said goods-storing room into said ventilation passage, to said goods-storing room is provided at an upper rear end of said goods-storing room, so as to cause at least part of air discharged therefrom to descend along the rear face of said goods-storing room between the rear face of said goods-storing room and rear ends of said goods shelves, and air passages are individually provided at lower faces of most of said goods shelves, so as to permit the air descending along the rear face of said goods-storing room to flow therethrough from the rear ends towards front ends of these goods shelves and permit part of the air flowing therethrough to be discharged downward, and said air passages are formed so as to discharge the air not only downward but also forward, wherein each of the goods shelves is comprised of upper and lower shelf plates spaced at a distance from each other and defining the air passage therebetween, with the lower shelf plate formed with a plurality of ventilation holes through which the air in the air passage is discharged, and wherein each of said goods shelves is provided at its rear end with an air guide member for causing the air descending along the rear face of said goods-storing room to flow into the air passage of the good shelf, and each of said goods shelves is provided with a plurality of air guide members spaced from one another in a width direction of the goods shelf, with the air guide members for an upper one of said goods shelves being smaller in number than those for a lower one of said goods shelves.

22. A showcase comprising:

a showcase body having a front opening;

a goods-storing room formed in said showcase body;

a plurality of goods shelves arranged in said goods-storing room so as to be vertically spaced from one another;

a ventilation passage formed along a rear face of said goods-storing room; and a cooler and a blower that are disposed in said ventilation passage, wherein an air outlet for discharging air, cooled by said cooler after being sucked through an air inlet provided at a lower front end of said goods-storing room into said ventilation passage, to said goods-storing room is provided at an upper rear end of said goods-storing room, so as to cause at least part of air discharged therefrom to descend along the rear face of said goods-storing room between the rear face of said goods-storing room and rear ends of said goods shelves, and air passages are individually provided at lower faces of most of said goods shelves, so as to permit the air descending along the rear face of said goods-storing room to flow therethrough from the rear ends towards front ends of these goods shelves and permit part of the air flowing therethrough to be discharged downward, wherein each of said goods shelves is provided at its rear end with an air guide member for guiding the air descending along the rear face of said goods-storing room into between the rear end of the goods shelf and the rear face of said goods-storing room.

* * * * *

UNITED STATES PATENT AND TRADEMARK OFFICE

CERTIFICATE OF CORRECTION

PATENT NO. : 6,971,247 B2
DATED : December 6, 2005
INVENTOR(S) : Shouichi Yamazaki et al.

It is certified that error appears in the above-identified patent and that said Letters Patent is hereby corrected as shown below:

Column 7,
Line 66, replace “limit” with -- front --.

Column 8,
Line 28, replace “to” with -- the --.
Line 57, replace “a” with -- an --.

Column 9,
Line 24, replace “a” with -- at --.

Signed and Sealed this

Thirty-first Day of January, 2006

JON W. DUDAS
*Director of the United States Patent and Trademark Office*